United States Patent [19]

Onishi et al.

[11] 4,171,008

[45] Oct. 16, 1979

[54] APPARATUS FOR DETECTING MALFUNCTION ON DRAWING OF CATCH YARNS IN A SHUTTLELESS LOOM

[75] Inventors: Kimimasa Onishi, Tokyo; Eiji Ichimatsu, Koganei; Mamoru Nagashima, Tokyo; Junnosuke Suekane, Musashi-murayama; Mikiyoshi Ogawa, Yokohama, all of Japan

[73] Assignee: Nissan Motor Company, Limited, Japan

[21] Appl. No.: 895,613

[22] Filed: Apr. 12, 1978

[30] Foreign Application Priority Data

May 26, 1977 [JP] Japan ..... 52-66925[U]

[51] Int. Cl.[2] ..... D03D 51/18

[52] U.S. Cl. ..... 139/339; 139/302

[58] Field of Search ..... 139/339, 302, 303, 304, 139/291 R, 291 C; 66/132, 163, 166; 19/26; 200/61.13, 61.15; 112/87, 219

[56] References Cited

U.S. PATENT DOCUMENTS

| | | | |
|---|---|---|---|
| 2,447,244 | 6/1941 | Lawson | 66/132 |
| 3,094,855 | 6/1963 | Vossen | 66/163 |
| 3,461,920 | 8/1969 | Sakamoto | 139/302 |
| 3,703,914 | 11/1972 | Freisler | 139/339 |

*Primary Examiner*—Henry Jaudon

*Attorney, Agent, or Firm*—Robert E. Burns; Emmanuel J. Lobato; Bruce L. Adams

[57] ABSTRACT

Catch yarns are drawn between a pair of rotatable members which are mounted to be movable toward and away from another and yieldably urged to come together. Detecting means detects the relative movement between the pair of rotatable members and produce an alarm-signal when the relative movement of one rotatable member away from another reaches a predetermined increased value.

The catch yarns in tensioned state are further utilized to hold the detecting means at a rest position thereof. The detecting means also produces an alarm-signal upon the breakage of the catch yarns.

6 Claims, 6 Drawing Figures

APPARATUS FOR DETECTING MALFUNCTION ON DRAWING OF CATCH YARNS IN A SHUTTLELESS LOOM

BACKGROUND OF THE INVENTION

This invention relates in general to a shuttleless loom of the type having a weft catching arrangement in which a plurality of weft catching yarns successively catch inserted weft yarns while being drawn at a required rate, and more particularly to an apparatus for detecting malfunction on drawing of the weft catching yarns in such weft catching arrangement.

As is well known in the art and is described to some extent in U.S. Pat. No. 3,297,057, a shuttleless loom, for example, of a fluid jet type is provided with a weft catching arrangement which comprises a plurality of weft catching yarns (hereinafter referred to as "catch yarns" for brevity) disposed in tensioned state on one side of a warp array. The catch yarns are adapted to form a shed like the shed formed in warp yarns and to be collected for grasping an inserted weft yarn by beating operation. In order to insure that the end portion of the inserted weft yarn is firmly grasped by the catch yarns and to tension the inserted weft yarn, the weft catching arrangement is provided with a twisting device for twisting the catch yarns having grasped the inserted weft yarn. The catch yarns are further adapted to be drawn at a rate equal to or larger than the rate at which the woven fabric moves toward a cloth roller, retaining the end portions of the inserted weft yarns even after they have been severed from the edge of the woven fabric. In order to draw the catch yarns as above, the weft catching arrangement of an ordinary type is provided with a catch yarn drawing device of the type which includes a pair of cooperative rotatable members such as spur gears or rollers, which nip therebetween the catch yarns and draw same by rotation thereof. The catch yarns having passed the catch yarn drawing device are then led downwardly by their gravity to some accumulating device or wound on a reel.

Although the catch yarns are arranged to be drawn as above, it happens that the catch are wound on one of the rotary members. This is caused by the fact that the filament or fibre consituting a catch yarn or a weft yarn is caught by some chipping or cutting marks on the peripheries of the rotary members or stuck in some sizing starch existing on same. As the catch yarns are wound on one rotary member, the catch yarn drawing rate increases gradually since the length of the catch yarns having wound effects the increases in the diameter of the rotary member. Such increase in the catch yarn drawing rate leads to imperfect weaving operation of the loom and finally to the breakage of the catch yarns.

The breakage of the catch yarns also happens for the cause of malfunction in the twisting device. For example, during twisting of the catch yarns by the twisting device, it happens, though on rare occasions, that one of the weft end portions retained by the catch yarns is tangled with some element of the twisting device to cause the breakage of the catch yarns.

Since the breakage of the catch yarns causes fatal disadvantages in weaving operation of the loom, it is desirable to give notice of the breakage to the operator of the loom so that the operator can repair or reset in order the catch yarns as early as possible, and it is more desirable to give notice of malfunction on drawing of the catch yarns to the operator before the catch yarns are broken so that the operator can reset the catch yarns in order through a simple resetting work and therefore a shorter resetting time.

SUMMARY OF THE INVENTION

It is accordingly an object of this invention to provide an apparatus for detecting malfunction on drawing of the catch yarns for use in the shuttleless loom with the foregoing type weft catching arrangement, which apparatus is optimally constructed and arranged to detect the irregular drawing of the catch yarns and produce an alarm-signal for warning about the breakage of the catch yarns.

It is another object of this invention to provide an apparatus for detecting malfunction on drawing of the catch yarns for use in the shuttleless loom with the foregoing type weft catching arrangement, which apparatus is optimally constructed and arranged to detect the irregular drawing or the breakage of the catch yarns and produce an alarm-signal for warning about the breakage of the catch yarns or for giving notice of the occurrence of the breakage of the catch yarns.

According to this invention, there is provided, in a shuttleless loom having a weft catching arrangement of the type including a plurality of catch yarns disposed on one side of an array of warp yarns for grasping and inserted weft yarn and catch yarn drawing means for drawing said catch yarn at a predetermined rate, said catch yarn drawing means having a pair of rotatable members which are cooperative to nip said catch yarns between their peripheries and draw same when driven to rotate in opposite directions of rotation, an apparatus for detecting malfunction on drawing of said catch yarns comprising: mounting means for mounting said rotatable members in such a manner as to permit relative movement between them toward and away from another; biasing means for yieldably urging said pair of rotatable members together to produce a yarn drive pinch; and detecting means for detecting the relative movement between said pair of rotatable members away from another and producing an alarm-signal upon detection of said relative movement reaching a predetermined increased value.

BRIEF DESCRIPTION OF THE DRAWINGS

These and other objects and advantages of this invention will become more apparent from the following description taken in conjunction with the accompanying drawings in which.

BRIEF DESCRIPTION OF THE PREFERRED EMBODIMENTS

Figure 1:
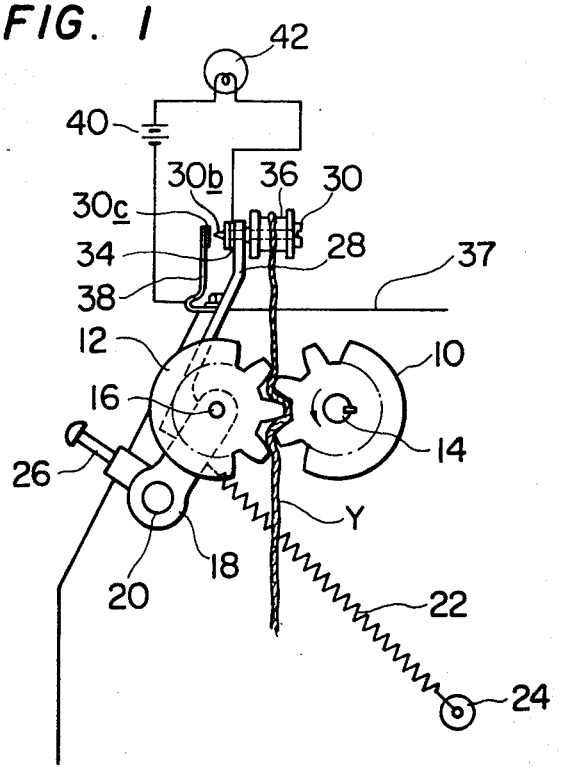
FIG. 1 is a schematic front view of a first preferred embodiment of an apparatus for detecting malfunction on drawing of catch yarns according to this invention, wherein the apparatus is in one operative position thereof responding to a regular drawing condition of catch yarns in which the catch yarns are being drawn in order by a catch yarn drawing device.
Figure 2:
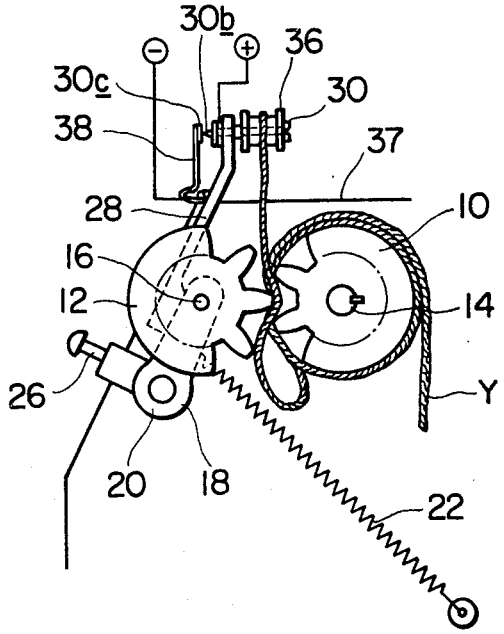
FIG. 2 is a schematic front view of the apparatus of FIG. 1, wherein the apparatus is in another operative position thereof corresponding to an irregular drawing condition of catch yarns in which the catch yarns are being drawn out of order by the catch yarn drawing device.
Figure 3:
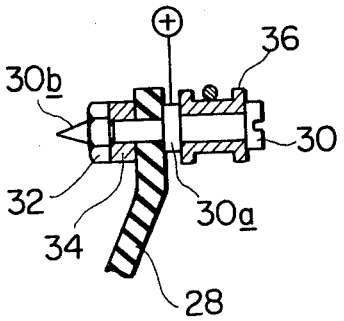
FIG. 3 is an enlarged fragmentary sectional view showing the arrangement provided to the free end portion of a pivotable support which is incorporated in the apparatus of FIG. 1.

Referring now to FIGS. 1 to 3 inclusive, there is shown a pair of cooperative rotatable members in the form of two spur gears 10 and 12 which are driven in opposite directions of rotation to draw catch yarns Y between them. The illustrated portion of the catch yarns Y is the portion which has passed through twisting means (not shown) for twisting the catch yarns Y to be bound. The gear 10 is fixedly mounted on a driving shaft 14 to rotate together therewith. The driving shaft 14 is driven by a suitable drive on a shuttleless loom (not shown) to rotate at a required rate in the direction of the arrow shown in the drawing, while the gear 12 is mounted on a spindle 16 and is rotatable thereon. The spindle 16 is fixed to a pivotable support 18 which is in turn mounted on a fixed pivot 20 to turn thereon. The pivotable support 18 is urged to turn clockwise as viewed in the drawing by the force of a pre-loaded tension spring 22 which is attached at one end to the pivotal support 18 and at the other end to a fixed member 24 on the loom. By the action of the spring 22, the driven gear 12 is yieldably urged toward the driving gear 10 to produce a suitable yarn drive pinch. A control lever 26 is fixedly attached to the pivotable support 18 in order to facilitate manual turn of the pivotable support 18 which moves together with the gear 12. That is, the control lever 26 is provided for temporarily positioning the gear 12 apart from the gear 10 so that the catch yarns Y can be easily disposed between the gears 10 and 12 and removed from same. The pivotable support 18 is provided with an arm 28 fixedly secured thereto. The arm 28 is made of an electrical insulation material such as a synthetic resin with a relatively high hardness and is configured, in this embodiment, to have an obliquely extending lower portion and a generally vertically extending upper portion. As is best seen in FIG. 3, the upper portion of the arm 28 is bored and through the bore is extended a metallic bolt 30 which is formed with an increased diameter portion 30*a* and a pointed end portion 30*b*. A metalic lock nut 32 is screwed on the bolt 30 for fixing the bolt 30 to the arm 28 with a terminal 34 being clamped between the nut 32 and the support 28. The pointed end 30*b* of the bolt 30, which serves as a movable contact of an alarm-signal generating electric circuit, which will be explained hereinlater, is thus electrically connected to the terminal 34. A guide roller 36 is rotatabely mounted on the bolt 30 for guiding the direction of the movement of the catch yarns Y so that the feed of the catch yarns Y between the gears 10 and 12 is maintained in order.

Designated by the reference numeral 37 is a portion of a frame of the shuttleless loom and on the frame 37 is fixed a lead 38 made of an electrically conductive material. As shown in FIGS. 1 and 2, the lead 38 is preferably of an L shaped configuration and further preferably of an ealstic material so that it can be elastically deformed by a relatively small external force. The lead 38 extends upwardly from the frame 37 and has an upper portion on which a contact 30*c* is fixedly attached. The contacts 30*b* and 30*c* are arranged such that they are normally opened or in a spaced relationship as shown in FIG. 1 and when the driven gear 12 is moved apart from the driving gear 10 over a predetermined distance they are closed or engaged as shown in FIG. 2. The movable contact 30*c* is electrically connected to one side of a power source or a battery 40. The other side of the battery 40 is electrically connected to an electric lamp 42 which is in turn electrically connected to the movable contact 30*b* through the terminal 34. The electrical connections thus far described are preferably formed through the frame 37. In this instance, it will be appreciated that the contacts 30*b* and 30*c*, the lead 38, the battery 40, the electric lamp 42 and the terminal 34 constitute the aforementioned alarm-signal generating electric circuit. The alarm-signal in this embodiment is thus the light produced by the electric lamp 42.

The operation of the apparatus thus far described is as follows:

The catch yarns Y are normally nipped between the gears 10 and 12 as shown in FIG. 1 and are drawn downwardly or toward the floor when the driving shaft 14 drives the gear 10 in the rotational direction of the arrow as illustrated in the drawing. The part of the catch yarns Y having delivered through the gears then falls under the effect of gravity. Under this normal or regular drawing condition of the catch yarn Y, the contacts 30*b* and 30*c* are held open since the pivotable support 18 is maintained substantially stationary at a rotational position thereof as illustrated in FIG. 1.

When, however, the catch yarns Y are fixed on one of the gears 10 and 12, for the sake of the afore-mentioned marks or sizing starch existing on the peripheries of the gears, and wound, for example, on the driving gear 10 as shown in FIG. 2, the gear 12 cannot fully engage the gear 10, i.e., the tooth of the gear 12 cannot fully enter the corresponding tooth space of the gear 10. As a result, the gear 12 moves apart from the gear 10, i.e., the axis of rotation of the gear 12 moves away from the axis of rotation of the gear 10 since the support 18 correspondingly turns on the pivot 20 counterclockwise as viewed in the drawing together with the gear 12 overcoming the bias of the spring 22. Accordingly, the arm 28 rotates about the pivot 20 counterclockwise with a result that the contacts 30*b* and 30*c* are closed or engaged. When the contacts 30*b* and 30*c* are thus closed, the alarm-signal generating electric circuit is made to turn on the electric lamp 42 for alarming the malfunction on drawing of the catch yarns Y.

Though the electric lamp 42 is utilized as an alarm-signal generating means in the embodiment thus far described, such can be replaced by a buzzer or a system for automatically stopping the weaving operation of the loom upon the engagement of the contacts 30*b* and 30*c*. Furthermore, the contacts 30*b* and 30*c*, which constitute switch means of the alarm-signal generating electric circuit, can be replaced by other switch means such as of a contactless type.

Figure 4:
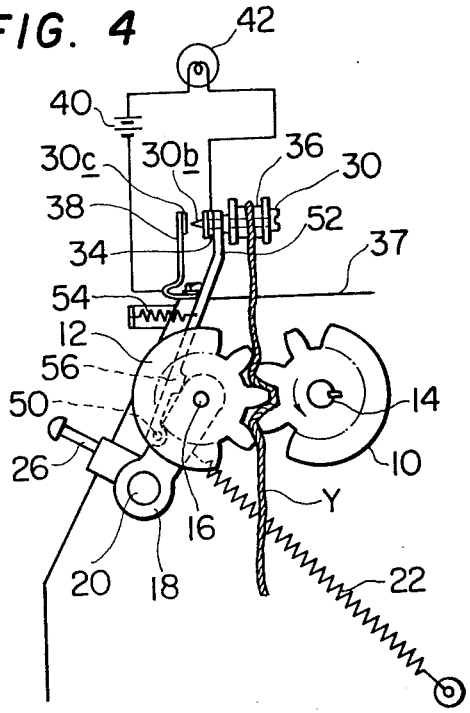
FIG. 4 is a schematic front view of a second preferred embodiment of an apparatus for detecting malfunction on drawing of catch yarns according to this invention, wherein the apparatus is in one operative position thereof corresponding to a regular drawing condition of catch yarns in which the catch yarns are being drawn in order by a catch yarn drawing device.
Figure 5:
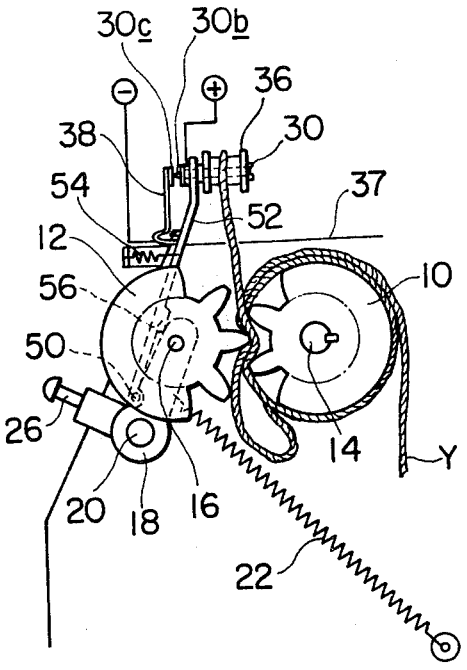
FIG. 5 is a schematic front view of the apparatus of FIG. 4, wherein the apparatus is in another operative position thereof corresponding to an irregular drawing condition of the catch yarns in which the catch yarns are being drawn out of order by the catch yarn drawing device.
Figure 6:
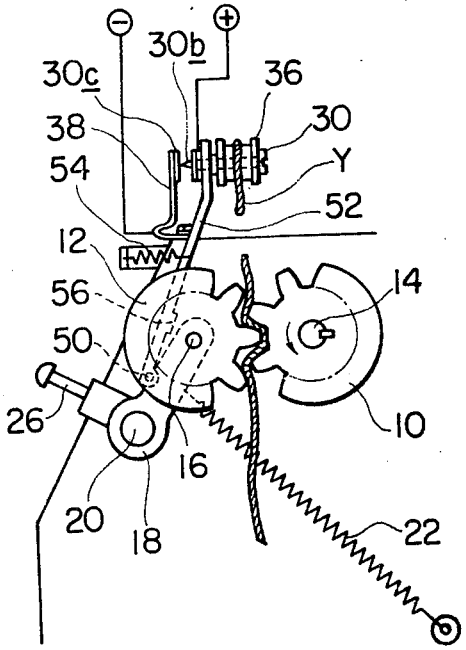
FIG. 6 is a schematic front view of the apparatus of FIG. 4, wherein the apparatus is in a yet other operative position corresponding to the breakage of the catch yarns.

Referring now to FIGS. 4 to 6 inclusive, the second embodiment of the apparatus for detecting malfunction on drawing of the catch yarns according to this invention will be explained. In FIGS. 4 to 6 inclusive, same parts to the first embodiment are given same reference numerals and will not be described in detail again.

The second embodiment is constructed and arranged such that it can detect the breakage of the catch yarns as well as the irregular drawing of the catch yarns.

In the drawings, the pivotable support 18 is provided with a stud or a fixed pin 50 on which is pivotably mounted a swingable arm 52. The swingable arm 52 is configured similar to the arm 28 of the first embodiment and carries at its upper end part the bolt 30, the nut 32, the guide roller 36 and the terminal 34 in a similar manner as the arm 28 does. A pre-loaded tension spring 54 is provided for yieldably urging the swingable arm 52 to turn about the stud 50 counterclockwise as viewed in the drawing. For achieving this spring action, one end of the spring 54 is secured to the swingable arm 52 while the other end is fixed on a suitable member fixedly connected to the frame 37.

In this connection, the spring 54 is weak or of a small spring constant so that the arm 52 is urged clockwise by the catch yarns Y in tensioned state overcoming the force of the spring 54 when the catch yarns Y are disposed properly or in order as illustrated in FIG. 4, i.e., when the catch yarns Y are in properly tensioned state being guided by the guide roller 36 and nipped between the gears 10 and 12. In order to hold the arm 52 thus urged at a rotational position thereof as illustrated in FIG. 4, means is provided for limiting the pivotal movement of said arm 52 in the direction to cause said pair of contacts **30*b* and 30*c* apart from another. In this embodiment, such means is formed as a projection 56 which is integral with the arm 52. With these constructions, the arm 52 can follow the movement of the support 18 as long as the catch yarns Y urge the arm 52 clockwise. However, if the tension of the catch yarns Y applied to the arm 52 is eliminated the arm 52 can turn counterclockwise by the force of the spring 54 independently of the movement of the support 18**.

The movable contact **30*b* is arranged to be out of engagement with the fixed contact 30*c* when the catch yarns Y are disposed in order as illustrated in FIG. 4 and contactable to same when the arm 52** turns counterclockwise as viewed in the drawing.

The operation of the apparatus thus far described is as follows:

FIG. 4 shows the normal operating condition of the apparatus corresponding to the regular drawing condition of the catch yarns Y.

In this operating condition of the apparatus, the swingable arm 52 is urged clockwise by the action of the catch yarns Y in tensioned state to abut onto the support 18 through the projection 56 and is held substantially stationary with the movable contact **30*b* being apart from the fixed contact 30*c***. Thus, when the catch yarns Y are being drawin in order, the alarm-signal generating circuit is open.

However, when the catch yarns Y are wound on one of the gears 10 and 12, for example the gear 10 as shown in FIG. 5, the tooth of the gear 12 cannot fully enter the corresponding tooth space of the gear 10 thus causing the gear 12 to move away from the gear 10. Accordingly, the support 18 turns counterclockwise as viewed in the drawing together with the arm 52 with a result that the movable contact **30*b* is in engagement with the fixed contact 30*c*. When the contacts 30*b* and 30*c* are thus closed, the alarm-signal generating electric circuit is made to turn on the lamp 42** to produce an alarm-signal for alarming malfunction on drawing of the catch yarns.

FIG. 5 shows the operating condition of the apparatus in which the alarm-signal generating electric circuit is made in response to the irregular drawing of the catch yarns Y.

Referring to FIG. 6, when breakage of the catch yarns Y occurs, the arm 52 alone turns counterclockwise about the pin 50 urged by the force of the spring 54 with the result that the movable contact **30*b* engages the fixed contact 30*c*. The alarm-signal generating electric circuit is thus made to turn on the lamp 42**. Accordingly, upon the occurrence of breakage of the catch yarns Y, the apparatus of this invention can produce an alarm-signal for giving notice of the occurrence of the breakage of the catch yarns.

In connection with the embodiments of FIGS. 4 to 6, it will be understood that the apparatus of this invention is operative to detect a predetermined slack in the catch yarns which may be developed when the catch yarns are slipped off the guide rollers 36 or out of clamp between the gears 10 and 12 as well as the breakage of the catch yarns for producing an alarm-signal.

Though the embodiments of the apparatus for detecting malfunction on drawing of the catch yarns according to this invention are thus far described and shown as to the application to a catch yarn drawing device of the type including a pair of cooperative gears, the apparatus can be readily applied to a catch yarn drawing device of the type including a pair of cooperative rollers according to the teachings of this invention.

What is claimed is:

1. In a shuttleless loom having a weft catching arrangement of the type including a plurality of catch yarns disposed on one side of an array of warp yarns for grasping an inserted weft yarn and catch yarn drawing means for drawing said catch yarns at a predetermined rate, said catch yarn drawing means having a pair of rotatable members cooperative to nip said catch yarns between their peripheries and draw same when driven to rotate in opposite directions of rotation, an apparatus for detecting malfunction on drawing of said catch yarns comprising:

mounting means for mounting said pair of rotatable members in such a manner as to permit relative movement between them toward and away from one another;

biasing means for yieldably urging said pair of rotatable members together to produce a yarn drive pinch; and detecting means for detecting the relative movement between said pair of rotatable members away from one another and producing an alarm-signal upon detection of said relative movement reaching a predetermined increased value.

2. An apparatus as claimed in claim 1, in which said mounting means comprises:

a stationary support mounting thereon one of said rotatable members; and a pivotable support movable relative to said stationary support and mounting thereon the other of said rotatable members, biasing means biasing said pivotable support to pivot in the direction of said stationary support so that said pair of rotatable members are urged together.

3. An apparatus as claimed in claim 1, in which said detecting means comprises:

an arm fixedly secured to said pivotable support so as to move integrally therewith;

a pair of cooperative electric contacts one of which is fixed and the other attached to said arm; and an alarm-signal generating electric circuit having said pair of electric contacts therein and being closed to produce said alarm-signal when said pair of electric contacts engage each other, said pair of electric contacts being arranged such that they engage each other when said other rotatable member is moved away from said one rotatable member over a distance corresponding to said predetermined value.

4. In a shuttleless loom having a weft catching arrangement of the type including a plurality of catch yarns disposed on one side of an array of warp yarns for grasping an inserted weft yarn and catch yarn drawing means for drawing said catch yarns at a predetermined rate, said catch yarn drawing means having a pair of rotatable members cooperative to nip said catch yarns between their peripheries and draw same when driven to rotate in opposite directions of rotation, an apparatus for detecting malfunction on drawing of said catch yarns comprising:

mounting means for mounting said pair of rotatable members as to permit relative movement between them toward and away from one another, said mounting means including a stationary support mounting thereon one of said rotatable members and a pivotable support movable relative to said stationary support and mounting thereon the other of said rotatable members;

biasing means operatively connected to said pivotable support to urge said pivotable support in the direction of said stationary support so that said pair of rotatable members is yieldably urged together to develop a yarn drive pinch;

detecting means operative to detect the relative movement between said pair of rotatable members away from each other for producing an alarm-signal upon detection of said relative movement reaching a predetermined increased value and further operative to detect a breakage of or a predetermined slack in said catch yarns for producing the alarm-signal, said detecting means including an arm pivotably mounted on said pivotable support to be movable relative thereto, a pair of cooperative electric contacts one of which is fixed and the other attached to said arm, second biasing means operatively connected to said arm for yieldably urging said arm in the direction to bring said pair of electric contacts into engagement, means for limiting the pivotal movement of said arm in a direction spacing said pair of electric contacts away from another such that said arm is held at its predetermined rotational position where said pair of electric contacts are out of engagement when urged by said catch yarns in tensioned state overcoming the bias of said second biasing means and is movable together with said pivotable support in a direction to bring said pair of electric contacts into engagement in accordance with the movement of said other rotatable member away from said one rotatable member, an alarm signal generating electric circuit having therein said pair of electric contacts and being closed to produce said alarm-signal when said pair of electric contacts engage each other, and said pair of electric contacts being arranged so as to engage each other when said other rotatable member is moved away from said one rotatable member over a distance corresponding to said predetermined value.

5. An apparatus as claimed in claim 4, in which said detecting means further comprise guide means mounted on said arm for guiding said catch yarns so as to be properly fed between said rotatable members.

6. An apparatus as claimed in claim 4, in which said limiting means comprise a projection integral with said arm.

* * * * *